US005222799A

United States Patent [19]

Sears et al.

[11] Patent Number: 5,222,799

[45] Date of Patent: Jun. 29, 1993

[54] STAIR LIGHTS

[75] Inventors: Lawrence A. Sears, Greeley; Gary Van Beek, North Gower, both of Canada

[73] Assignee: Diamond Stairlight Industries, Nepean, Canada

[21] Appl. No.: 661,207

[22] Filed: Feb. 27, 1991

[51] Int. Cl.[5] ..... F21S 1/02

[52] U.S. Cl. ..... 362/146; 362/246; 362/800

[58] Field of Search ..... 362/146, 226, 240, 251, 362/246, 361, 375, 800, 295

[56] References Cited

U.S. PATENT DOCUMENTS

| | | | |
|---|---|---|---|
| 4,164,008 | 8/1979 | Miller et al. | 362/800 X |
| 4,173,035 | 10/1979 | Hoyt | 362/812 X |
| 4,439,818 | 3/1984 | Scheib | 362/250 |
| 4,612,606 | 9/1986 | Roberts | 362/146 |
| 4,884,178 | 11/1989 | Roberts | 362/241 |
| 4,947,291 | 8/1990 | McDermott | 362/295 X |
| 5,038,255 | 8/1991 | Nishihashi et al. | 362/240 X |

FOREIGN PATENT DOCUMENTS

| | | |
|---|---|---|
| 598868 | 5/1960 | Canada . |
| 2045415 | 10/1980 | United Kingdom . |
| 2099036 | 12/1982 | United Kingdom . |
| 2208425 | 3/1989 | United Kingdom . |

*Primary Examiner*—Stephen F. Husar

*Attorney, Agent, or Firm*—Vorys, Sater, Seymoure & Pease

[57] ABSTRACT

A lighting strip for illuminating domestic stairways at the stair riser and stair tread that is both safe and relatively inexpensive. The device provides a lighting strip for supplying low level lighting in staircases or the like having, a means for providing a low level regulated voltage output from an ac voltage supply, a plurality of light means, a housing means for receiving and holding the light means, and the housing means is adapted to be installed under the juncture of a stair riser and stair tread, and connector means connects the light means to the low level voltage output.

10 Claims, 4 Drawing Sheets

STAIR LIGHTS

FIELD OF THE INVENTION

This invention relates to a device for providing low-level illumination in a staircase or the like.

BACKGROUND OF THE INVENTION

Miniature strips of lights (called strip lighting) are a convenient solution to providing low level safety lighting in special situations. These liggts are especially good for illuminating alcoves, bookshelves, highlighting pictures or walls or, if bright enough, task lighting and such like. Commercially available strip lighting is normally comprised of a strip of incandescent miniature light bulbs. Each of these light bulbs is normally connected in parallel to a common power supply which supplies 110 volts to the bulbs. In some cases a lower voltage of 12 to 24 volts dc or ac is supplied to the bulbs. The strips are normally available in long lengths that can be cut to the required number of bulbs, to suit a particular situation.

Incandescent bulbs have the disadvantage o being relatively inefficient for any required wattage or luminosity. A large percentage of power supplied to incandescent bulbs is generated as heat. Therefore to supply a given power to a string of light bulbs, one needs a relatively bulky power supply due to the inefficiency of the incandescent bulbs. Another disadvantage of incandescent light bulbs is that the life span is fairly short, and this requires bulbs to be changed at fairly regular intervals. Any housing or covering around the strip lighting has to be easily removable in order to access the light bulbs. This adversely effects the compactness of any housing design. The addition of extra light bulbs at a later stage will also require considerable increase in power supply output. In a specific case of a domestic or like stairway it is desirable to illuminate a stair riser under the lip of the stair tread so as to make the riser and tread visible in the dark, but at the same time the strip light must be physically unobtrusive. Commercially available strip lighting suffer from the disadvantages, mentioned above, therefore these lights are not entirely suited to this specific application. It is preferable in a strip light for use in stair cases to have a long life, be compact and be supplied from a low voltage power source which is inherently safe. The light should also be easily installed, by the average homeowner, with minimal requirements for tools.

SUMMARY OF THE INVENTION

The present invention seeks to provide a lighting strip for illuminating domestic stairways or the like that is both safe and relatively inexpensive and avoids the problems of the prior art lighting strips as mentioned above.

In accordance with the present invention there is provided a lighting strip for supplying low level lighting in staircases or the like comprising, a means for providing a low level voltage output from an ac voltage supply; a plurality of light sources; housing means for receiving and holding said light sources; said housing means is adapted to be installed under the juncture of a stair riser and stair tread, connector means for connecting said light sources to said low level voltage output.

BRIEF DESCRIPTION OF THE DRAWINGS

In order that the invention may be understood and readily carried into effect the following description is made with reference to the accompanying drawings in which.

DESCRIPTION OF PREFERRED EMBODIMENT

Figure 1:
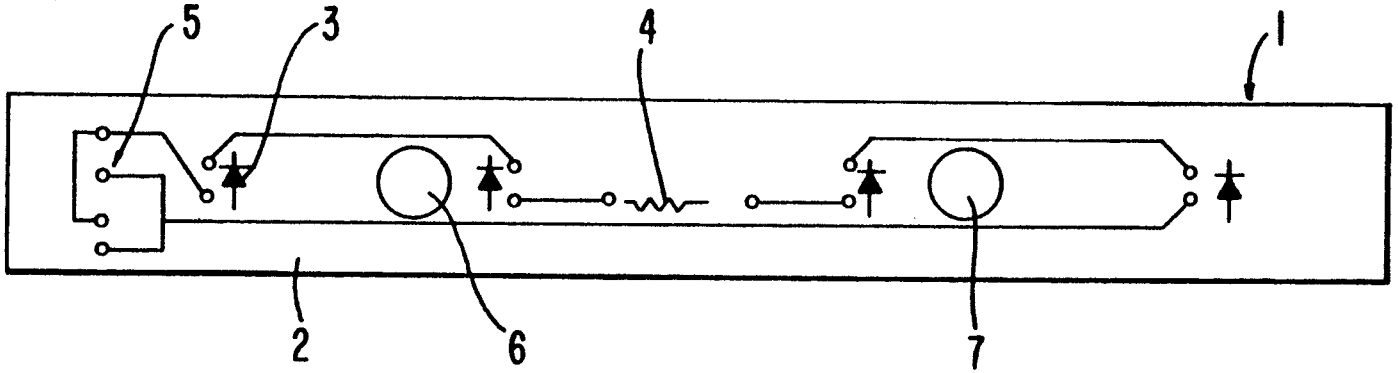
FIG. 1 is a schematic diagram of a printed circuit board strip according to the present invention.

Referring to FIG. 1, a printed circuit board 1 is shown for mounting the light emitting diodes according to the present invention. The printed circuit board has nominal dimensions of 0.635 inches wide by 5 inches long, and is preferably made from single sided copper faced fibreglass reinforced plastic, although other materials could be used. Four light emitting diodes 3 are mounted on one surface, which we shall call the front surface 2 at regular intervals of approximately 1.2 inch centers. The number of light emitting diodes were chosen in this embodiment to be four to achieve a predetermined efficiency (amount of light vs. energy consumed) and evenness of illumination over a desired area. However, this number can be varied for different requirements. Printed circuit tracks for conducting power to the light emitting diodes are etched on the copper side of the board. The light emitting diodes are connected in series with a current limiting resistor 4. A power supply is connected to the tracks on the board along one edge 5 which has holes pre-drilled to accommodate a connector such as a MOLEX* connector. This connector is not specifically shown in the diagrams as any suitable connector could be used. Holes 6 and 7 are made in the printed circuit board to allow an attaching screw (not shown) or the like to pass therethrough.

Figure 2:
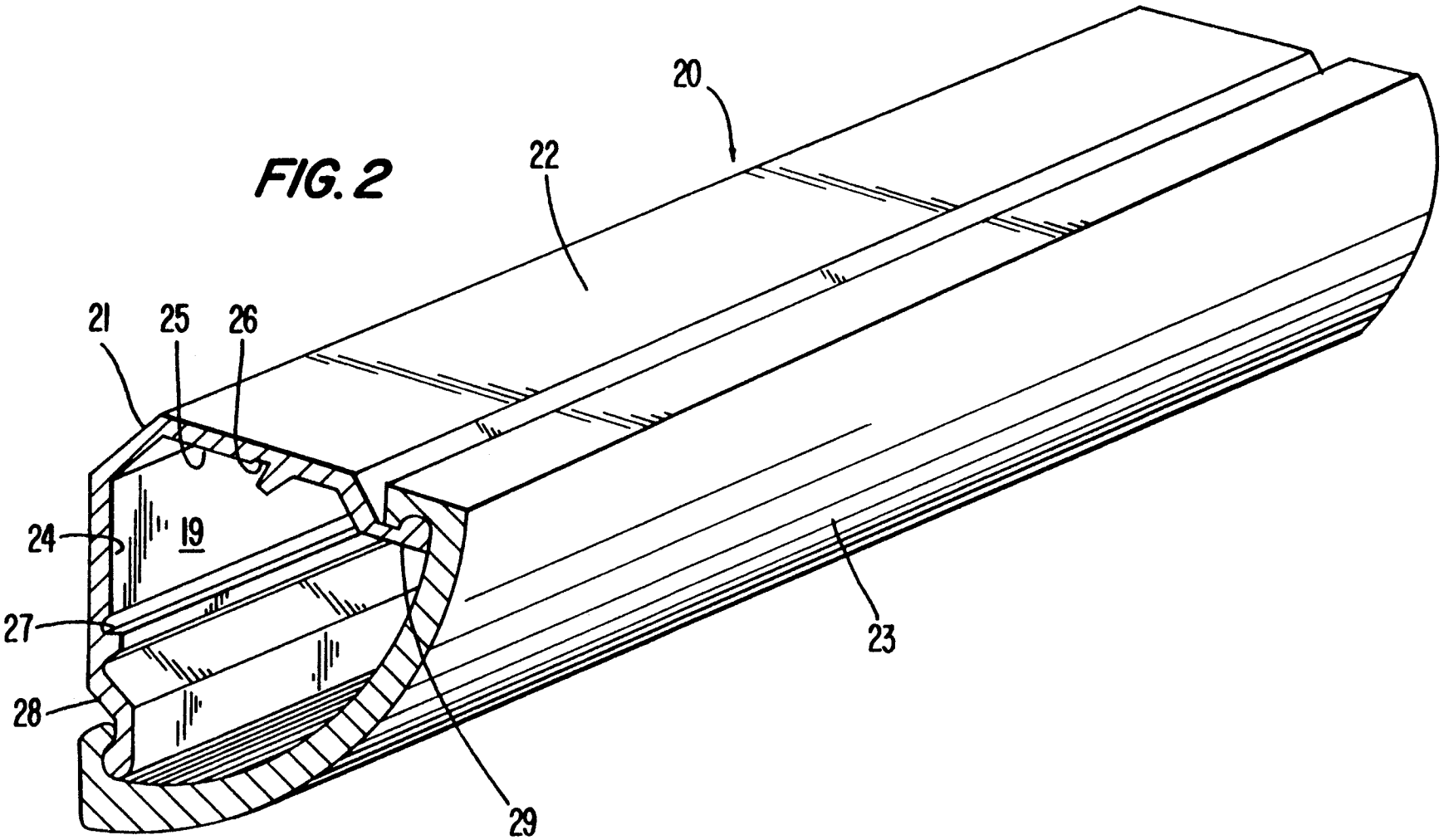
FIG. 2 is an isometric view of a housing according to the present invention.

FIG. 2 is a view of a housing, shown generally as 20, for mounting the printed circuit board 1 as illustrated in Figure The housing has a base clip 22 and a diffuser 23. The base clip has a back portion 21 and two elongated projections 24 and 25 which form an interior area 19. The interior surfaces of the projections 24 and 25 facing each other have grooves 27 and 26 moulded along their respective lengths. The length of the above clip is approximately 6 inches. These grooves allow the printed circuit board to be mounted in the base clip by inserting one end of the board into the grooves and sliding the board along the length of the base clip and to be supported by the said grooves in this base clip. Extending from each of the projections 24 and 25 are further projections 28 and 29. These projections also extend along the length of support clip and allow the diffuser 23 to be slidably fitted thereover.

The diffuser 23 has a somewhat radial cross section along its length and is a quadrant of a circle of radius 0.75 inches. The peripheral edges of the diffuser are inwardly curved like a claw to allow the ends to mate with the outwardly curved ends 28 and 29 of the base clip 22. The diffuser is preferably made of a transparent acrylic type plastic and the support clip is preferably made of rigid PVC plastic, although other suitable materials are available.

Figure 3:
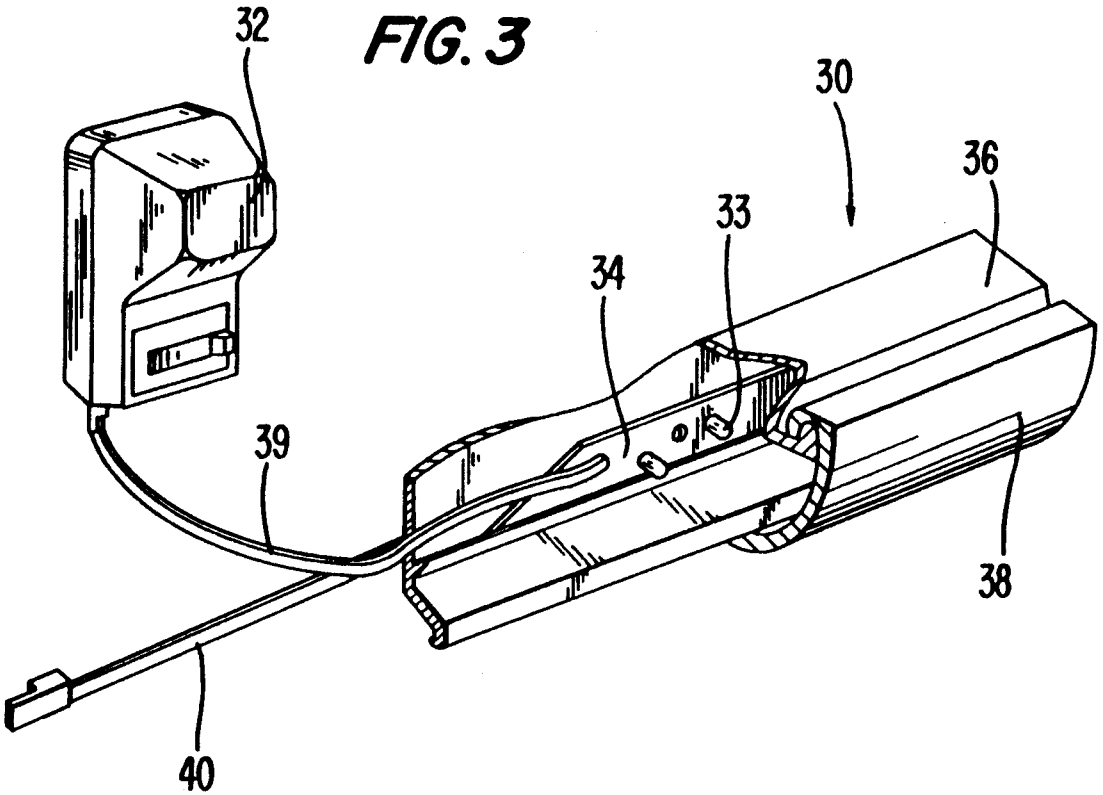
FIG. 3 is an isometric view of the invention as assembled.
Figure 4B:
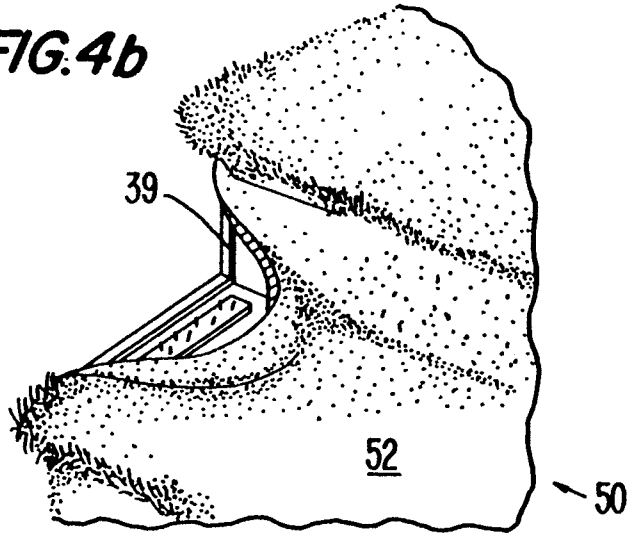
FIGS. 4*a*–4*d* are schematic diagrams showing the invention in use.
Figure 4D:
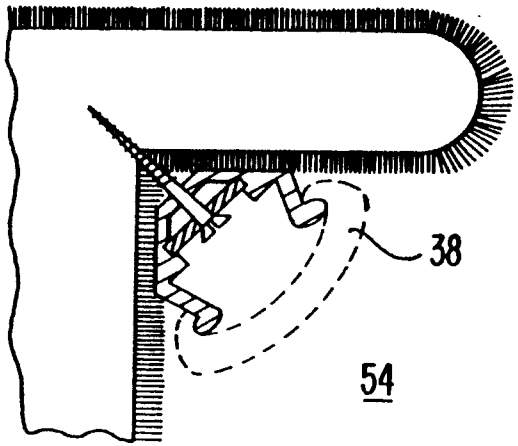
Figure 4A:
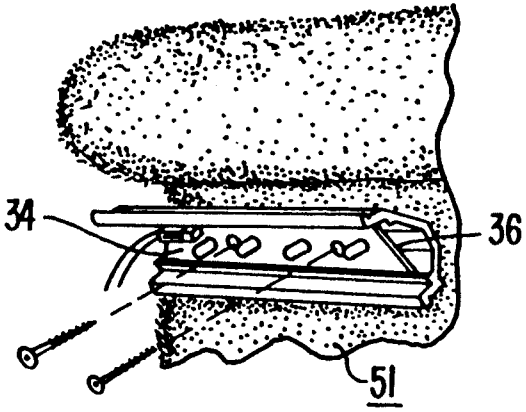
Figure 4C:
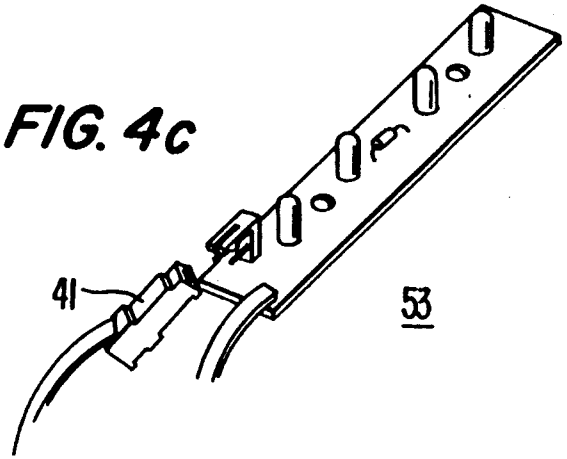

Referring to FIG. 3 an assembled stairlight unit is shown generally by numeral 30. This stairlight unit is provided with a power supply 32 which plugs into any standard 110 volt ac household outlet and which also has a brightness level switch which controls the dc power or current supplied to the light emitting diodes 33 mounted on the printed circuit board 34. The combination of the assembled base clip 36, lens 38 and LED's shall be referred to as a light bar. The power supply has a standard two prong male connector to be inserted into any convenient standard household electrical receptacle. The printed circuit board is shown mounted as a slide fit in a base clip 36, over which is mounted the diffuser 38. The power cord 39 is normally supplied in a 7' length and is directly soldered to the power connections on the printed circuit board. An additional power cord 40 of length 26 inches is attached in parallel to the power cord 39 at the printed circuit board 34. The power cord 40 is terminated in a connector 41 for connection to a second light bar (not shown). In this fashion successive connections can be made for the entire staircase. The voltage output of the power supply is normally set to 12 volts. Each light bar normally draws 0.3 watts when set at a maximum brightness level.

Referring to FIGS. 4*a*–4*d*, where like numerals refer to similar structures as described in FIG. 3, the steps in the installation of the stairlights are sequentially shown by diagrams 50. The first step 51 in installing light bars is to fix the back of each base clip in place under the lip at the juncture of the stair tread and riser of each stair with screws. Holes, as mentioned earlier, are pre-drilled in the circuit board 34 and the back of the base clip 36 for this purpose. The next step 52, requires wire 39 for connections between each unit to be tucked along the edge of the carpet or the base board to previous light bars. The wire is tacked into place using double headed tacks or similar fixing devices. The carpet is then pressed back into place. The next step is shown by box numbered 53. At the end of each interconnecting wire is a connector 41 which is snapped onto a corresponding connector on the next light bar. The transparent acrylic diffuser cover 38 is slid onto place over the support clip, step 54. The ac adaptor is plugged in (not shown) and turned on. The unit is now fully functional.

Further improvements or additions can be made to the circuit and the device without departing from the spirit or scope of the invention.

The embodiments of the invention in which an exclusive property of privilege is claimed are defined as follows:

1. A lighting device for providing low level lighting in staircase or the like comprising:

means for providing low level voltage output from an ac voltage supply; a plurality of light sources;

a stranslucent diffuser;

housing means for receiving and holding said light sources;

said housing means including a rigid plastic base clip having a front portion for receiving said translucent diffuser thereon, said diffuser having peripheral edges formed for cooperation with mating means on said front portion of said base clip for removably attaching said diffuser to said base clip and a flat back portion for installing said base claip to a stair riser and stair tread on a staircase to provide illumination thereof;

connector means for connecting said light sources to said low level voltage output supply.

2. A device as defined in claim 1, said plurality of light sources are light emitting diodes.

3. A device as defined in claim 2, wherein said light emitting diodes include a current limiting means connected in series with said light emitting diodes.

4. A device as defined in claim 3, said current limiting means is a resistor.

5. A device as defined in claim 3, said light emitting diodes and said current limiting resistor being mounted on a circuit board means.

6. A device as defined in claim 1, said base clip having grooves moulded therein said grooves for slidably receiving a carrier for said light sources.

7. A device as defined in claim 1, said low level voltage output being switchable to selectively output a plurality of voltages.

8. A device as defined in claim 4, said base clip having grooves moulded therein said grooves for slidably receiving a carrier for said light sources.

9. A lighting strip kit for providing low level lighting under staircase risers or the like comprising:

a dc power supply;

a lighting bar having a plurality of ligh emitting diode light sources;

housing means for receiving and holding said light sources; said housing means including a translucent diffuser, and a rigid plastic base clip having a front portion for receiving said translucent diffuser thereon, said diffuser having peripheral edges formed for cooperation with mating means on said front portion of said base clip for removably attaching said diffuser to said base clip and a flat back portion for installing said base clip in proximity to a stair riser and stair thread of a strircase to provide illumination thereof;

a power cord for electrically connecting said dc power supply to said light bar;

means for attaching said power cord to said light bar;

means for attaching said light bar to a surface.

10. A lighting device for providing low level lighting in staircases or the like comprising:

means for providing low level voltage output from an ac voltage supply;

a plurality of light emitting diodes connected in series with a current limiting resistor; and said diodes and resistor mounted on a circuit board;

said housing means including a translucent diffuser, and a rigid plastic base clip having a front portion for receiving said translucent diffuser thereon, said diffuser having peripheral edges formed for cooperation with mating means on said front portion of said base clip for removably attaching said diffuser to said base clip and a flat back portion for installing said base clip in proximity to a stair riser and stair tread of a staircase to provide illumination thereof;

connector means adapted to be attached to said circuit board for electrically connecting said light emitting diodes to said low level voltage output.

* * * * *

UNITED STATES PATENT AND TRADEMARK OFFICE

CERTIFICATE OF CORRECTION

PATENT NO. : 5,222,799

DATED : June 29, 1993

INVENTOR(S) : Lawrence A. Sears and Gary Van Beek

It is certified that error appears in the above-identified patent and that said Letters Patent is hereby corrected as shown below:

On the title page, item (30), insert the following:

Canada 2,023,699 Aug. 21, 1990.

Col 3, line 55: The word "stranslucent" should be --translucent--.

Col. 3, line 64: The word "claip" should be "clip".

Col. 4, line 4: The term --means for providing-- should be added before "low", and the word "supply" should be deleted.

Col. 4, line 5: The word --wherein-- should be added before the word "said".

Col. 4, lines 7 and 8: The phrase "said light emitting diodes include" should be deleted.

Col. 4, line 8: The verb --is-- should be inserted after "means".

Col. 4, line 10: The word --wherein-- should be added before the word "said".

Col. 4, line 12: The word --wherein-- should be added before the word "said".

Col. 4, line 15: The word --wherein-- should be added before the word "said".

UNITED STATES PATENT AND TRADEMARK OFFICE

CERTIFICATE OF CORRECTION

PATENT NO. : 5,222,799

DATED : June 29, 1993

INVENTOR(S) : Lawrence A. Sears and Gary Van Beek

It is certified that error appears in the above-identified patent and that said Letters Patent is hereby corrected as shown below:

Col. 4, line 18, The word --wherein-- should be added before the word "said".

Col. 4, line 21: The word --wherein-- should be added before the word "said".

Col 4., line 16: The phrase "said grooves" should be deleted.

Col. 4, line 22: The phrase "said grooves" should be deleted.

Col. 4, line 18: --means for providing-- should be inserted after "said".

Col. 4, line 41: The word "light" should be replaced with --lighting--.

Col. 4, line 42: The word "light" should be replaced with --lighting--.

Col. 4, line 43: The word "light" should be replaced with --lighting--.

Col. 4, line 51: The word "said" should be deleted.

UNITED STATES PATENT AND TRADEMARK OFFICE

CERTIFICATE OF CORRECTION

PATENT NO. : 5,222,799

DATED : June 29, 1993

INVENTOR(S) : Lawrence A. Sears, et al.

It is certified that error appears in the above-indentified patent and that said Letters Patent is hereby corrected as shown below:

Column 4, line 63, The phrase "means for providing" should be inserted before "low".

Signed and Sealed this

Twenty-sixth Day of April, 1994

*Attest:*

Bruce Lehman

BRUCE LEHMAN

*Attesting Officer*

*Commissioner of Patents and Trademarks*